United States Patent [19]

Aoyama et al.

[11] 4,035,985

[45] July 19, 1977

[54] METHOD AND APPARATUS FOR WRAPPING GOODS IN A STRETCHABLE FILM MATERIAL

[75] Inventors: Kozo Aoyama, Tokyo; Hiroshi Iijima, Kawasaki; Shizuo Kikuchi, Yokohama, all of Japan

[73] Assignee: Asahi-Dow Limited, Tokyo, Japan

[21] Appl. No.: 620,195

[22] Filed: Oct. 6, 1975

Related U.S. Application Data

[63] Continuation of Ser. No. 536,293, Dec. 24, 1974, abandoned.

[30] Foreign Application Priority Data

| | | |
|---|---|---|
| Dec. 29, 1973 | Japan | 49-4150 |
| June 21, 1974 | Japan | 49-70149 |
| June 22, 1974 | Japan | 49-70818 |
| July 2, 1974 | Japan | 49-75055 |
| July 15, 1974 | Japan | 49-80214 |

[51] Int. Cl.[2] ..... B65B 43/30

[52] U.S. Cl. ..... 53/30 R; 53/33; 53/184 R; 53/222; 53/292

[58] Field of Search ..... 53/30, 33, 222, 184, 53/284, 292, 22 A, 226

[56] References Cited

U.S. PATENT DOCUMENTS

| | | | |
|---|---|---|---|
| 2,615,200 | 10/1952 | Cloud | 53/30 |
| 2,757,499 | 8/1956 | Albrecht | 53/226 |
| 3,662,513 | 5/1972 | Fabbri | 53/33 |

FOREIGN PATENT DOCUMENTS

| | | | |
|---|---|---|---|
| 540,606 | 10/1941 | United Kingdom | 53/226 |

*Primary Examiner*—Leon Gilden

*Attorney, Agent, or Firm*—Cushman, Darby & Cushman

[57] ABSTRACT

An apparatus for wrapping goods in a sheet of a stretchable film material comprises a resiliently deformable pad above a wrapping station, a gripping device for holding fast edge portions of the sheet so that the sheet extends horizontally beneath the pad, a mechanism for upwardly stretching a central portion of the sheet to form a bubble until the top of the bubble reaches the pad, a mechanism for lifting goods to be wrapped into the bubble until the top of the goods is urged against the inner surface of the top of the bubble and two pairs of tucking plates disposed to form a rectangle around the lower part of the bubble and movable inwardly to tuck the marginal portions of the bubbled sheet against the bottom of the goods. The goods are not brought into frictional engagement with the sheet during the stretching whereby the sheet is stretched uniformly throughout the bubbled central portion thereof. The marginal portions of the sheet thus tucked present such a symmetrical regular folding pattern as seams appearing in one surface of closed adhesive envelope.

45 Claims, 30 Drawing Figures

METHOD AND APPARATUS FOR WRAPPING GOODS IN A STRETCHABLE FILM MATERIAL

This is a continuation, of application Ser. No. 536,293 filed Dec. 24, 1974 now abandoned.

BACKGROUND AND SUMMARY OF THE INVENTION

The present invention relates to method and apparatus for wrapping goods in a sheet of an elastic and stretchable film of a plastics material such as polyvinyl chloride or ethylene vinyl acetate copolymer.

Method and apparatus of the class specified above are disclosed in U.S. Pat. No. 3,662,513 issued May 16, 1972 to Ermanno Fabbri, Italy. According to the U.S. Patent referred to, a sheet of film intended to form a packaging envelope and severed from a continuous web is set up in stretched condition under a folding matrix plate having therein a passage opening corresponding to goods to be wrapped or packaged. The goods are then moved vertically upwardly through the passage opening in the folding matrix plate while at least two opposite edges of the sheet are held fast so that the sheet is upwardly stretched in the central portion thereof to form a bubble or bag-like envelope and is drawn over the goods. The edges of the stretched sheet are then folded under the goods and pressed against the under surface thereof to complete a package of the goods.

The method and apparatus disclosed in the U.S. Patent have advantageously solved the problem that stretchable film materials usable with stretch packaging were very difficult to handle because of their inherent properties, i.e., softness, ductility, deformability, adhesiveness and tendency of forming folds. The prior art method and apparatus, however, had a difficulty in that the goods were urged against the sheet to upwardly stretch the sheet for thereby forming the bubble or bag-like wrapper. There were many cases in which goods to be wrapped and irregular shapes and had projections extending from the general contour of the goods. In addition, when goods to be wrapped were foods, they were usually placed in a tray of a molded plastics material. When such a tray with irregular-shaped goods thereon was wrapped in a sheet of such a stretchable film material, the projections on the goods and sharp edges of the tray were brought into frictional engagement with the sheet during the stretching thereof with the result that the sheet was unevenly stretched. A part of the sheet between projections on the goods was stretched more or less than other parts of the sheet extending between projections on the goods and the edges of the tray depending upon the difference in friction between the projections on the goods and the sheet and between the tray edges and the sheet. In some cases, stretched sheets were broken at the point of engagement with such projections and tray edges. Thus, a stretchable film to be used with the prior art had to be selected on the consideration of the slidability of the film with respect to particular shapes of goods to be wrapped and the material from which a tray to be associated with the goods was made. On the other hand, such a film material was also required to have an adhesiveness so as to facilitate convenient adhesive sealing of edge portions of the sheet against the bottom surface of the tray. The slidability and adhesiveness are the opposite properties and, thus, it was impossible to obtain a stretchable film material which would meet with all of the requirements. Moreover, the slidability and adhesiveness are greatly influenced by the ambient temperature. The prior art, therefore, uneconomically needed a number of different kinds of film materials for different goods, different trays and different seasons.

The present invention aims to provide method and apparatus for wrapping goods in a sheet of a stretchable plastics film material by which frictional engagement between a sheet and a tray as well as goods thereon is avoided during a sheet stretching step to thereby eliminate the prior art difficulty discussed.

According to one feature of the present invention, there is provided a method of wrapping goods in an elastic and stretchable plastics film paterial, comprising feeding a sheet of the plastics film material to a predetermined position above goods to be wrapped and beneath a resiliently deformable bearing means, subjecting said sheet to a differential pressure to form an upwardly stretched bubble in the central zone of said sheet while portions of said sheet adjacent at least two opposite edges thereof are held fast until the top of the bubble is engaged by said bearing means, causing relative movement of said goods with respect to the bubbled sheet to introduce said goods into the bubble until the top of said goods is urged against the portion of said sheet engaged by said bearing means, and tucking the edges of said sheet against the side of said goods remote from the bubble to secure said edges together. As is conventional, the term "goods" as used herein means one or more articles (either on tray or separate from a tray).

According to another feature of the invention, there is provided an apparatus for wrapping goods in an elastic and stretchable plastics film material, comprising a wrapping station, resiliently deformable bearing means at said wrapping station, means beneath said bearing means for supporting goods to be wrapped, means for feeding a sheet of the plastics film material to a position beneath said bearing means and above goods supported on said goods supporting means, means for producing differential pressure across the thickness of said sheet until the top of the bubble is engaged by said bearing means, means for holding fast portions of said sheet adjacent at least two opposite edges thereof while said sheet is subjected to the differential pressure, means for causing relative movement of said goods supporting means and goods thereon with respect to the bubbled sheet to introduce said goods into the bubble until the top of said goods is urged against the portion of the bubbled sheet engaged by said bearing means, and means for tucking the edges of said sheet against the side of said goods remote from the bubble to secure said edges together.

Preferably, the differential pressure may be produced by applying a gaseous pressure, such as pressurized air, to the under surface of the sheet and/or applying suction to the upper surface of the sheet. The gaseous pressure may be either produced in the apparatus or obtained from an external pressure source. In the case where goods to be wrapped are fresh foods, the sheet may advantageously be stretched and bubbled by a pressurized gaseous medium which would be effective to keep the foods sound, such as $N_2$, $O_2$ or $CO_2$.

The deformable bearing means may be a pad of a resiliently deformable material. Alternatively, the bearing means may comprise a deformable bag of a fluid impermeable flexible sheet material and containing a fluid. The bearing means is depressed upwardly and resiliently bears the top of a bubble when the top of the bubble is urged against the bearing means by goods to be wrapped. The upwardly depressed portion of the bearing means is in intimate frictional engagement with the upper part of the bubbled sheet, so that the marginal portions of the sheet are not liable to be upwardly pulled by the resilient shrinkage of the stretched upper part of the bubble when the marginal portions are tucked. In an embodiment in which suction is applied to the sheet to form a bubble, the bearing means may advantageously comprise a pad of a gas permeable cellular material having open cells therein, such as a foamed plastics material, so that air above the sheet is evacuated through the open cells in the pad.

Intermittently driven endless belts may be used to draw a length of a web of a stretchable film material from a roll of the web and feed the drawn length of web to the wrapping station at which a sheet of the film may be severed from the continuous web. Alternatively, a fluid pressure actuation piston-cylinder assembly may be employed to feed a length of the web to the wrapping station.

The tucking means employed in the apparatus of the invention may preferably comprise four tucking plates diposed to form a rectangle extending around power part of a bubble in which goods to be wrapped are introduced. The tucking plates of each pair may be disposed in substantially horizontally aligned opposite relationship with each other and movable toward each other to tuck the marginal portions of the bubbled sheet against the bottom surface of the goods.

The adhesiveness inherent to stretchable plastics film material is generally sufficient to retain the tucked marginal portions of a sheet of the film on the bottom surface of a tray for a while. However, the tucked edge portions may positively be secured together preferably by means of heat sealing if a produced package of goods is intended for storage for a long time.

According to the method and apparatus of the present invention, goods to be wrapped are not brought into frictional engagement with the central portion of a sheet of a stretchable film material during a stretching step with a resultant advantage that the central portion of the sheet can be uniformly stretched throughout the central portion. This advantageously eliminates the prior art problem that a particular kind of a film material had to be used with a particular shape of goods, with a tray of a particular material and at a particular ambient temperature.

BRIEF DESCRIPTION OF THE DRAWINGS

The invention will now be described by way of example with reference to the accompanying drawings.

DETAILED DESCRIPTION OF THE INVENTION

Figure 1:
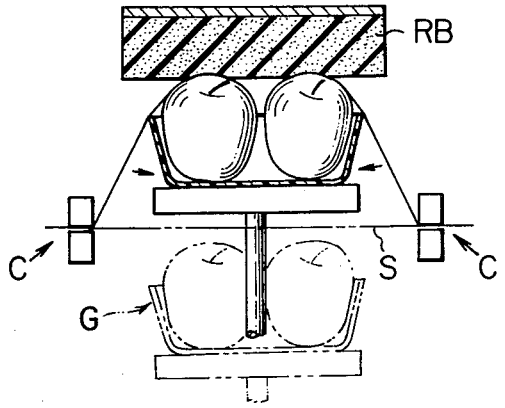
FIG. 1 PRIOR ART
FIG. 1 is a diagrammatic illustration of the prior art wrapping operation.

Referring to FIGS. 2 to 7F, the wrapping apparatus according to one embodiment of the present invention is generally indicated by 10 and comprises a machine frame including a base 12, end walls 14 and 16 upstanding from the opposite ends of the base and a substantially horizontal top wall 18 having a length less than that of the base 12 and positioned substantially centrally of the length of the machine frame. Intermediate horizontal walls 15 and 17 extend inwardly from the upper ends of the end walls 14 and 16 and are connected to upper vertical walls 19 and 20 depending from the top wall 18 to provide forward and rearward shoulders on the machine frame.

Figure 3:
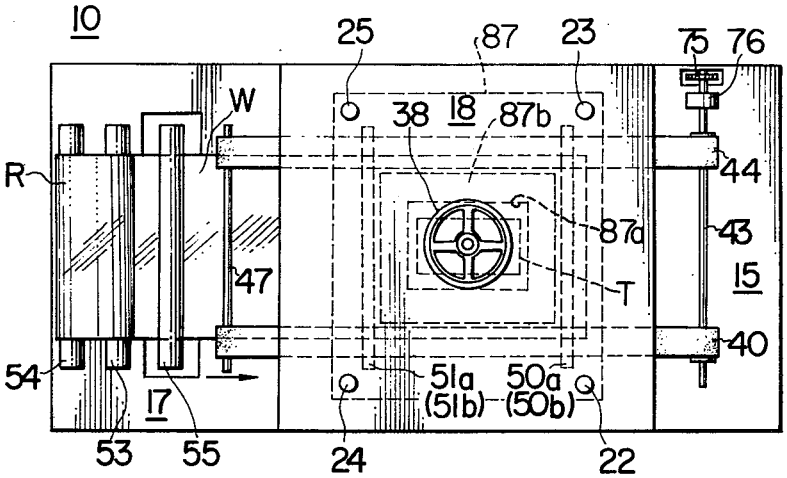
FIG. 3 is a schematic top plan view of the apparatus shown in FIG. 2.

Four posts 22, 23, 24 and 25 extend substantially vertically through the machine frame and have their one ends secured to the base 12 and the other ends secured to the top wall 18 adjacent the four corners thereof, as best seen in FIG. 3. A pad 30 of a resiliently deformable material, such as a foamed urethane, is disposed at a wrapping station WS and secured to a back-up plate 32 positioned beneath the top wall 18 and supported by an adjust screw 34 vertically extending through the top wall 18 and being in thread engagement with an internally threaded boss 36 secured to the top wall in the central portion thereof. A handle 38 is rigidly connected to the upper end of the adjust screw 34 so that the screw is rotated relative to the boss 36 and the top wall to adjust the level of the resiliently deformable pad 30.

Figure 4:
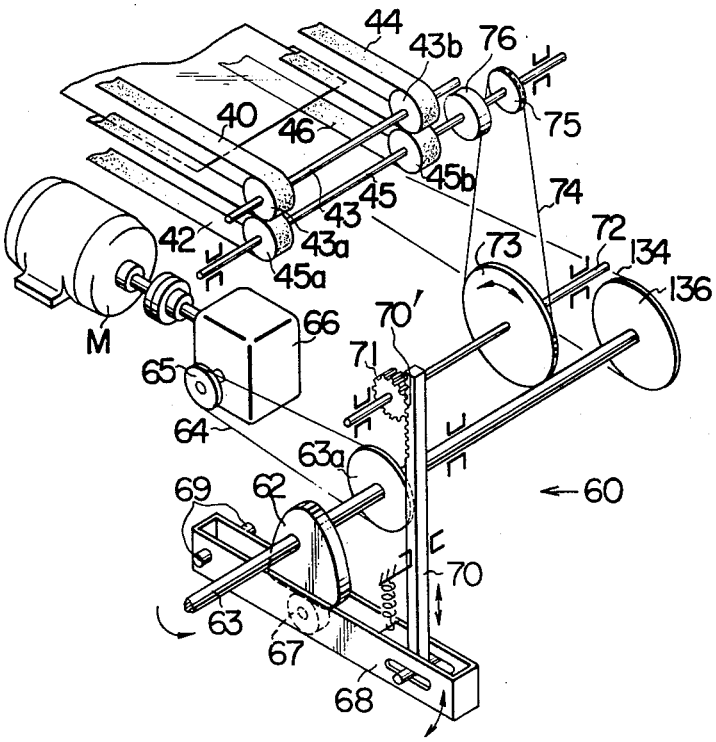
FIG. 4 is a fragmentary perspective view of sheet feeding endless belts and a driving mechanism therefor.

The upper vertical walls 19 and 20 are formed therein with openings **19*a* and 20*a* through which a pair of upper and lower endless belts 40 and 42 extend horizontally below the resiliently deformable pad 30 and around two pairs of upper and lower pulleys 43***a* and 45*a* and 47*a* and 49*a*, one pair 43*a* and 45*a* being disposed above the shoulder 15 and the other pair 47*a* and 49*a* above the other shoulder 17. The pulleys are arranged such that the pair of endless belts 40 and 42 have mating runs extending in close contacting relationship with each other. The mating runs are further pressed together by means of two pairs of upper and lower pressure rollers 50*a* and 50*b* and 51*a* and 51*b* for the purpose to be made apparent later. As shown in FIGS. 3 and 4, another pair of similar upper and lower endless belts 44 and 46 are similarly provided and extend in laterally spaced parallel relationship to the belts 40 and 42 and through the openings 19*a* and 20*a* and around pulleys 43*b* and 45*b* at one ends of their runs. The pairs of pulleys 43*a* and 43*b* and 45*a* and 45*b* are connected by shafts 43 and 45, respectively, so that the pairs of pulleys are rotated together. The belts 44 and 46 also extend around another pair of pulleys which are not shown but provided above the shoulder 17 and connected to the pulleys 47*a* and 49*a*, respectively. The belts 44 and 46 also have mating runs extending in close contacting relationship with each other and pressed together by the pressure rollers 50*a* to 51*b*. The two parallel pairs of endless belts extend between the two pairs of posts 22 and 24 and 23 and 25, as will be seen in FIG. 3.

A roll R of a continuous web of a resiliently stretchable plastics film material is rotatably mounted on the shoulder 17 by means of a pair of rollers 53 and 54. A length of the web W is adapted to be unwound from the roll R and extends around a dancer roller 55. The mating runs of the respective pairs of endless belts 40 to 46 are adapted to grip or sandwich therebetween the side edges of the forward free end portion of the unwound length of the web W and intermittently driven by a driving means to be described later so that the mating runs are moved step by step in the direction indicated by an arrow A to feed a length of the web W to the wrapping station WS in each step. The pairs of pressure rollers 50*a* and 50*b* and 51*a* and 51*b* assure that the side edges of the forward free end portion of the web W are prevented from being slipped off the mating runs of the parallel pairs of the endless belts during the stepping movements thereof.

In one practical example, the endless belts and the web of the film material are dimensioned as follows:

Width of each endless belt — 50 mm.
Diameter of fresh roll R — 130 mm.
Width of web W — 300 mm.
Overlap between each side edge of web W and one endless belt — 15 to 20 mm.

Referring to FIG. 4, the driving means of the endless belts 40 and 46 are generally indicated by 60 and include a cam member 62 rigidly secured to a cam shaft 63 which is drivingly connected to an electric motor M through an endless belt 64 extending around a pulley 63*a* on the shaft 63 and around a second pulley 65 secured to an output shaft of a reduction gear 66 which in turn is drivingly coupled to the motor M. The cam member 62 is in rolling contact with a cam follower 67 rotatably mounted on an arm 68 having an end pivotally connected by pivot pins 69 to a stationary machine part, not shown. A rack bar 70 having a bottom end pivotally connected to the other end portion of the arm 68 extends substantially vertically and is provided with a series of teeth 70' in meshing engagement with a pinion 71 rigidly secured to a rotatable shaft 72 to which is rigidly secured a sprocket 73. It will be appreciated that the rotation of the motor M continuously rotates the cam member 62 which in turn oscillates the arm 68 to cause substantially linear reciprocal movements of the rack bar 70 so that the pinion 71 and the sprocket 73 are rotated in alternate directions. The sprocket 73 is drivingly connected by an endless chain belt 74 to a sprocket 75 which is connected through a clutch 76 to an extension of the shaft 45. The clutch 76 is intended to transmit to the pulleys 45*a* and 45*b* the intermittent rotational motions of the sprocket 75 in only one direction so that the endless belts 42 and 46 are driven intermittently or step by step. For this purpose, the clutch 76 may be either a uni-directional clutch or an electromagnetic clutch. The stepping motions of the endless belts 42 and 46 are transmitted to the associated endless belts 40 and 44 due to the frictional engagement between the upper and lower belts of respective pairs.

Referring again to FIG. 2, an open-topped tubular member 80 having a rectangular cross-section is disposed beneath the resiliently deformable pad 30 in vertical alignment therewith and below the endless belts 42 and 46. The lower end of the member 80 is closed by a bottom wall 82 which extends outwardly beyond the outer peripheral surfaces of the member 80 to form a peripheral bottom flange 84 having four sleeve members 85*a* to 85*d* (85*b* and 85*d* not shown) extending through the flange 84 adjacent the four corners thereof and secured to the flange, as will be best seen in FIG. 5. The sleeve members surround the posts 22 to 25, respectively, and are slidable thereon so that the tubular member 80 is reciprocally movable up and down along the posts when driven by a driving means to be described later. The tubular member 80 is also provided with an upper flange 86 extending outwardly from the peripheral top edge of the member 80.

A flat frame member 87 is provided above the mating runs of the endless belts 40 to 46 and beneath the pad 30 and mounted on the posts 22 to 25 by means of ring members (only two 88 and 89 of which are shown). The frame member 87 is formed with a rectangular opening 87*a* therein and has a peripheral bead 87*b* provided on the under surface of the member 87 and extending along the peripheral edge of the opening 87*a*. The bead 87*b* is substantially vertically aligned with the flange 86 of the tubular member 80 and has longitudinal dimension (from the left to the right as viewed in FIG. 2) which is less than the horizontal distance between the pairs or pressure rollers 50*a* and 50*b* and 51*a* and 51*b*, as will be best seen in FIGS. 2 and 3. The dimension of the bead 87*b* in the transverse direction is less than the distance between the laterally spaced pairs of the endless belts 40 to 46, as shown in FIG. 3. Thus, it will be appreciated that the tubular member 80 can be actuated upwardly until the upper flange 86, which is smaller than the flat frame member 87, is moved upwardly through a rectangular space defined between the two pairs of the pressure rollers 50*a* to 51*b* and the two pairs of the endless belts 40 to 46 into engagement with the bottom face of the bead 87*b*. Accordingly, it will be apparent that, if the forward end portion of the web W is present in the wrapping station WS at that time, the flat flame member 87 cooperates with the upper flange 86 of the tubular member 80 to grip the forward end portion of the web.

A knife 90 is provided along a rearward side edge of the upper flange 86 to sever a sheet of the film material from the length of web when the web is gripped by the flat frame member 87 and the upper flange 86 of the tubular member 80. However, the remainder of the drawn length of web is still gripped along its side edges by the pairs of endless belts 40 to 46, so that a new leading edge of the web is not released off the belts.

The bottom wall 82 of the tubular member 80 is formed therein with an opening into which a conduit 92 from a gaseous pressure source is connected. A valve means 94 is provided in the conduit 92 and adapted to be opened, when the upper flange 86 of the tubular member 80 is urged against the flat frame member 87, to allow a pressurized gas to flow the source into a chamber defined by the tubular member and a sheet of the film material in engagement therewith. For this purpose, the valve means 94 is preferably a solenoid valve which is controlled by means of a limit switch, not shown, associated with one of the upper flange 86 of the tubular member 80 and the flat frame member 87.

In the bottom wall 82 of the tubular member 80 is formed a central bore, in slidable sealing engagement with which a rod 100 extends vertically and has its top end connected with a horizontal flat member 102 which is adapted to support thereon goods to be wrapped. A sleeve-like member 104 is secured to the under surface of the bottom wall 82 of the tubular member 80 around the central bore therein to axially guide the rod 100 when the same is upwardly and downwardly moved, as will be described later.

Figure 2:
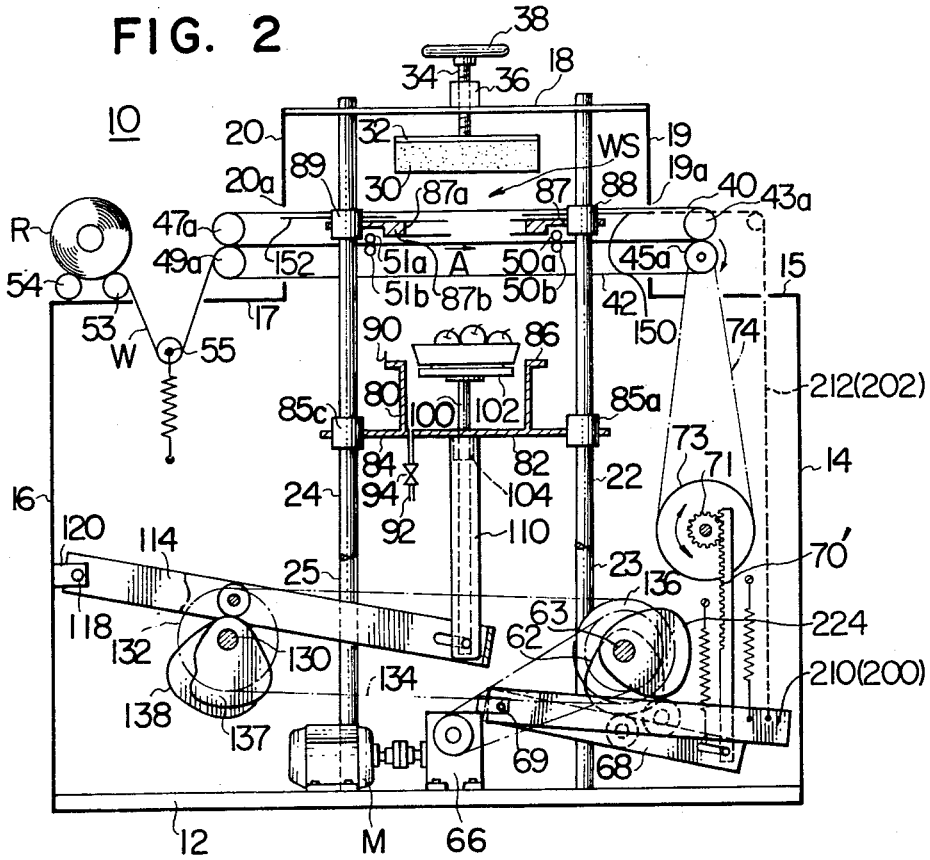
FIG. 2 is a partially sectional schematic side view of an embodiment of the apparatus according to the present invention.

As best seen in FIG. 5, a pair of bars 110 and 112 are rigidly connected at their upper ends to the lower flange 84 of the tubular member 80 and extend downwardly therefrom. The bars 110 and 112 have their bottom ends pivotally connected as at 111 and 113 to one ends of rocker arms 114 and 116, respectively, which are pivotally connected at the other ends to the end wall 16 of the machine frame by means of a common shaft 118 and brackets 120 (only one of which is shown in FIG. 2). The rod 100 also has its bottom end pivotally connected as at 122 to one end of another rocker arm 124 which is disposed between the rocker arms 114 and 116 and pivotally connected at the other end to the shaft 118.

A shaft 130 extends transversely of the rocker arms 114, 116 and 124 and below the arms and carries thereon a pulley 132 which is drivingly connected by an endless belt 134 to a pulley 136 secured to the shaft 63, as will be seen in FIGS. 2 and 4. The shaft 130 has three cam members 137, 138 and 139 which are rigidly mounted on the shaft and in rolling engagement with cam followers 115, 125 and 117 rotatably mounted on the rocker arms 114, 124 and 116, respectively, so that the rotation of the cam members oscillates the rocker arms about the axis of the shaft 118 to reciprocally move the tubular member 80 and the flat member 102. The cam members 137 and 139 have substantially the same profile and extend substantially in the same radial direction with respect to the axis of the cam shaft 130. The cam members 137 and 139 are formed with arcuate recesses **137*a* and 139*a* in the peripheries thereof for the purpose to be made apparent later. The other cam member 138 extends in a slightly different radial angle as compared with the cam members 137 and 139 and is slightly larger than the cam members 137 and 139. The arrangement is such that, when the cam shaft 130 is rotated in counterclockwise direction as viewed in FIG. 5, the tubular member 80 is first lifted and followed by the upward movement of the flat member 102**.

Assuming that a sheet of the film material is present beneath the flat frame member 87 when the tubular member is lifted, the upper flange 86 of the tubular member 80 cooperates with the bottom surface of the peripheral bead **87*b* of the frame member 87 to grip the sheet adjacent its peripheral edges. Then, pressurized gas may be introduced through the conduit 92 and the valve 94 into the closed space defined by the tubular member 80 and the sheet to upwardly stretch the sheet in its central area for thereby forming a bubble which is ballooned into and through the opening 87*a* until the top of the bubble is engaged by the under surface of the resiliently deformable pad 30. Thereafter, the flat member 102 with goods thereon may be moved upwardly by the cooperation of the cam member 138 with the rocker arm 124 to introduce the goods into the bubble until the top of the goods is urged against the portion of the bubbled sheet in engagement with the pad 30**.

Referring to FIGS. 2, 6 and 7A to 7F, means are provided for tucking the edge portions of the bubbled sheet against the side of the goods remote from the bubble to secure the edge portions and the side of the goods together. In the embodiment shown, the tucking means are in the form of two pairs of tucking plates 150 and 152 and 154 and 156. The tucking plates are disposed slightly above the flat frame member 87, as will be seen in FIG. 2. The opposite tucking plates 150 and 152 of one of the pairs are substantially horizontally aligned, whereas the tucking plates 154 and 156 of other other pair are slightly vertically offset for the reason to be discussed later. The two pairs of the tucking plates are slightly vertically offset so as not to interfere each other. The tucking members of each pair are normally spaced a distance substantially equal to one side of the opening **87*a* in the flat frame member 87 and movable toward each other to fold the opposite edge portions of the bubbled sheet after the goods to be wrapped have been moved into engagement with the inner surface of the top of the bubble in engagement with the pad 30. For this purpose, the opposite tucking members 150 and 152 of one of the pairs are biased toward each other by tension springs 151*a* and 151*b* extending therebetween while the tucking members 154 and 156 of the other pair are biased by similar tension springs 155*a* and 155*b* extending therebetween, as will be seen in FIG. 6**.

The tucking plate 150 is connected to a substantially rigid horizontal bar member 160 by means of a pair of strings such as wire cables **161*a* and 161*b* extending outwardly from the plate 150, around pulleys 162*a* and 162*b* and downwardly to the bar member 160, the pulleys being mounted on a common shaft 163 extending parallel with the outer edge of the plate 150 and with the bar member 160. The tucking plate 152 is similarly connected to the bar member 160 by means of a pair of wire cables 165*a* and 165*b* extending outwardly from the plate 152 and around pulleys 166*a* and 166*b* both on a shaft 167 extending parallel with the outer edge of the plate 152. The cable 165*a* extends from the pulley 166*a*, around pulleys 168*a* to 172*a* and to the bar member 160. Similarly, the other cable 165*b* extends from the pulley 166*b*, around pulleys 168*b* to 172*b* and to the bar member 160. The tucking plate 154 is connected to a substantially rigid horizontal bar member 180 by means of a pair of similar wire cables 181*a* and 181*b* extending outwardly from the plate 154, around pulleys 182*a* and 182*b* and then downwardly to the bar member 180, respectively. The pulleys 182*a* and 182*b* are mounted on a shaft 183 extending parallel with the outer edge of the plate 154 and the bar member 180. The other tucking plate 156 is also connnected to the bar member 180 by means of a pair of wire cables 185*a* and 185*b* extending outwardly from the tucking member 156 and around a pair of pulleys 186***a* and 186*b* mounted on a horizontal shaft 187 extending parallel with the outer edge of the plate 156. The cable 185*a* extends from the pulley 186*a,* around pulleys 188*a* to 192*a* and then to the bar member 180, whereas the other cable 185*b* extends from the pulley 186*b,* around 188*b* to 192*b* and then to the bar member 180.

The bar member 160 is mounted on stationary machine parts 160*a* and 160*b* for upward and downward movement and connected to a rocker arm 200 by means of a wire cable 202 extending downwardly from the bar member 160, around idler pulleys 204 and 206 to the arm 200. The bar member 180 is mounted on other stationary machine parts 180*a* and 180*b* for upward and downward movement and connected to another rocker arm 210 by means of a wire cable 212 extending downwardly from the arm 180, around idler pulleys 214 and 216 to the arm 210. The rocker arms 200 and 210 are pivotally connected to pivot pins 201 and 211, respectively, which are substantially coaxial with the pivot pin 69. Cam members 220 and 224 are rigidly mounted on the shaft 63 and are in rolling contact with cam followers 222 and 226 rotatably mounted on the rocker arms 200 and 210, respectively. The cam members 220 and 224 have substantially similar shape and extend substantially in the same radial direction with respect to the axis of the shaft 63 so that the rocker arms 200 and 210 are oscillated simultaneously with the simultaneous inward and outward reciprocal movement of the two pairs of tucking plates 150 and 152 and 154 and 156. The cam members 220 and 224 on the shaft 63 are angularly offset from the cam member 62, which is also mounted on the shaft 63, so that the rocker arm 68 is first moved downwardly to feed a predetermined length of web of the film material to the wrapping station WS (in FIG. 2) and, after the lapse of a predetermined time, the rocker arms 200 and 210 are moved upwardly to permit the pairs of tucking plates 150 and 152 and 154 and 156 to be pulled inwardly by the pairs of tension springs 151*a* and 151*b* and 155*a* and 155*b.*

The arrangement of the cam members 220 and 224 with respect to the axis of the shaft 63 permit the two pairs tucking members 150 and 152 and 154 and 156 to be simultaneously moved inwardly as the cam members are further rotated. However, one of the cam members 224 may be angularly offset from the other cam member 220, as illustrated in broken lines 224' in FIG. 6 so that the tucking plates 150 and 152 of one of the pairs are moved outwardly and inwardly in advanced of the outward and inward movement of the tucking plates 154 and 156 of the other pair, as will be discussed in more detail later.

Figure 6:
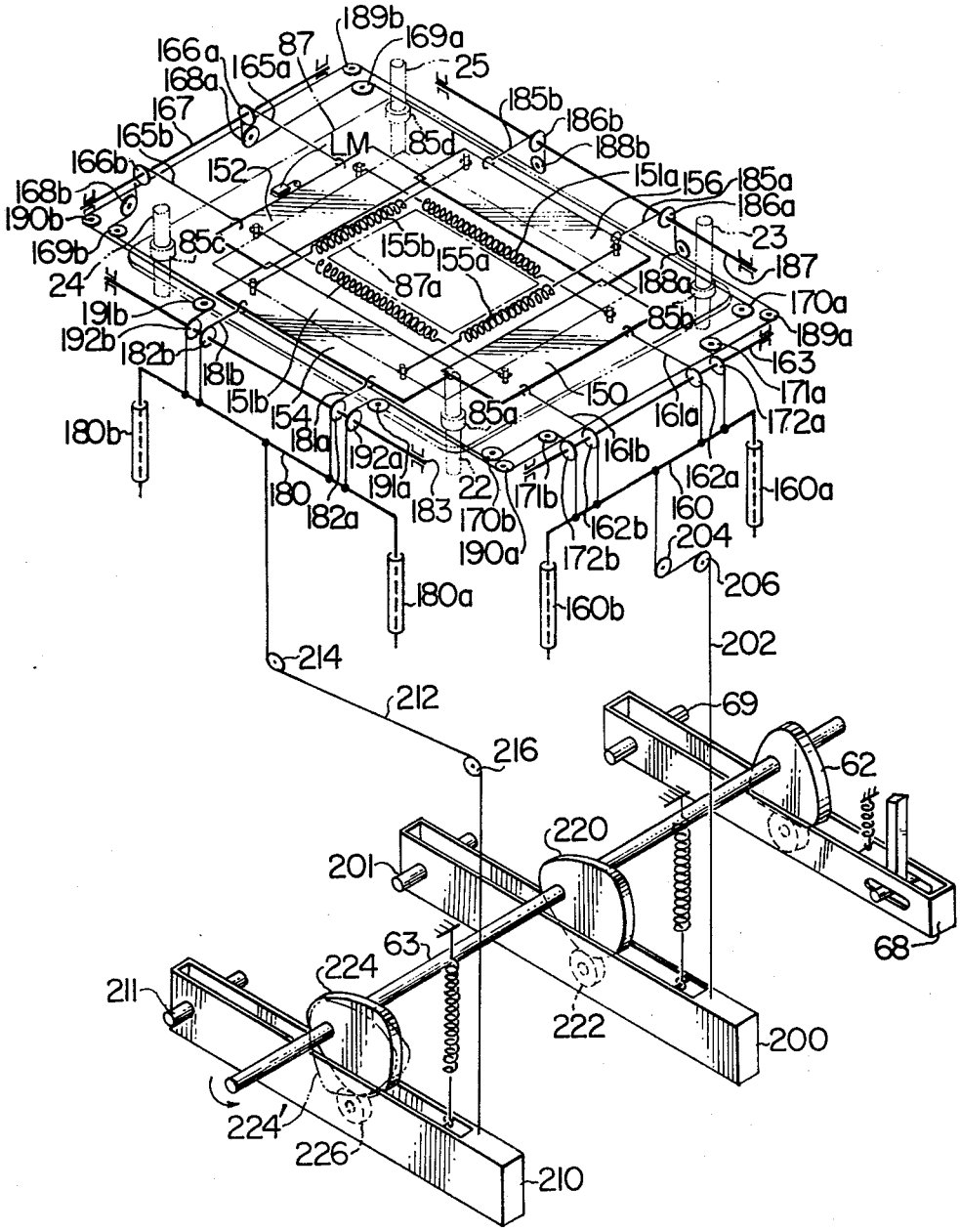
FIG. 6 is a schematic perspective view of tucking plates and a driving mechanism shown in FIG. 2.
Figure 7A:
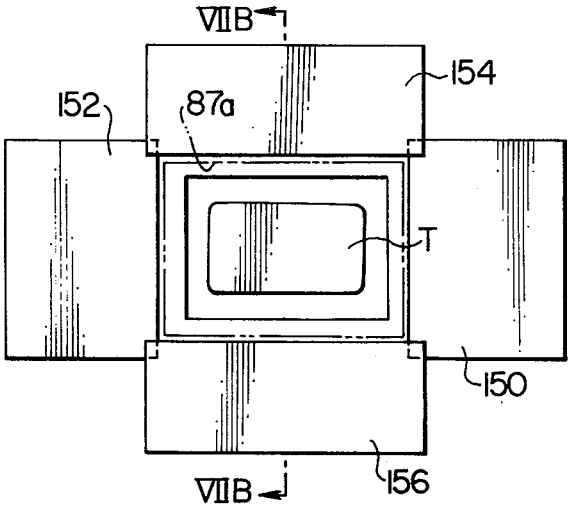
FIGS. 7A, 7C and 7E are bottom views of the tucking plates shown in FIG. 6 and a tray with the tucking plates being shown in different positions.
Figure 7B:
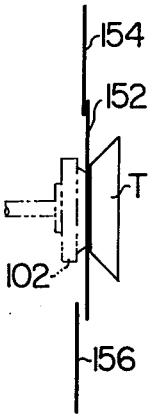
FIGS. 7B, 7D and 7F are sectional views taken along lines VIIB — VIIB in FIG. 7A, VIID — VIID in FIG. 7C and VIIF — VIIF in FIG. 7E, respectively.
Figure 7C:
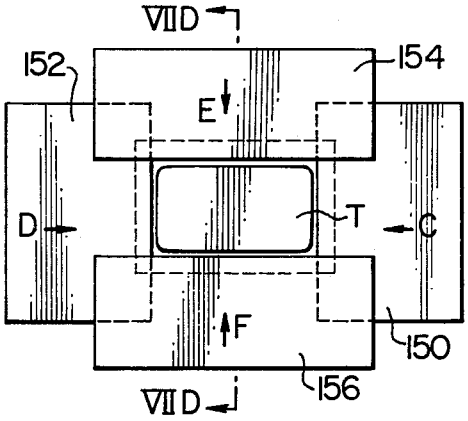
Figure 7D:
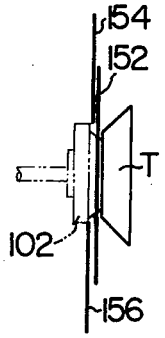
Figure 7E:
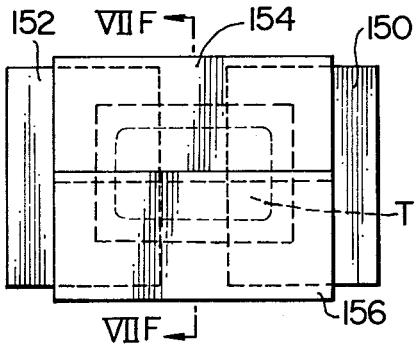
Figure 7F:
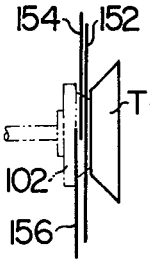

FIGS. 7A, 7C and 7E illustrate in bottom view the tucking plates in different positions and a tray T for goods and FIGS. 7B, 7D and 7F are sections taken along lins VIIB — VIIB, VIID — VIID and VIIF — VIIF in FIGS. 7A, 7C and 7E, respectively. As shown in FIGS. 6 and 7A, the tucking plates 150 to 154 have their outermost positions in which the tucking plates are overlapped at adjacent corners, the overlap being such that the plates 150 and 152 of one pair extend above the plates 154 and 156 of the other pair as viewed in FIG. 6. In their innermost positions, the tucking plates 150 to 156 extend as shown in FIGS. 7E and 7F. As will be best seen in FIG. 7F, the plates 154 and 156 of the pair which is remote from the bottom surface of the tray T are overlapped in their innermost positions, whereas the plates 150 and 152 are spaced a distance from each other. FIGS. 7B, 7D and 7F show the tucking plates 150 to 156 as being substantially spaced in vertical direction for the sole purpose of illustration. In fact, the tucking plates extend in close contacting relationship one to another and mutually guide or slide one on another when they are moved inwardly and outwardly. Preferably, each tucking plate is made of a substantially flat sheet of a metal such as aluminum or an aluminum-base alloy and has a thickness of about 1.5 millimeters. The inner edges of respective tucking plates 150 to 156 are preferably rounded as viewed in section so as not to damage the sheet of the film when the plates are inwardly moved to tuck edge portions of the sheet.

In order that the tucking members may be smoothly moved for a tucking operation, the flat member 102 is moved upwardly to its uppermost position in which the top surface of the member 102 extends in a horizontal plane which is slightly upwradly spaced a distance which is preferably from 1.5 to 5.0 millimeters from the lower pair of tucking members 154 and 156. In addition, the flat member 102 may be bevelled along the four sides thereof so as to function as guides for the tucking members when they are wedged into the gap between the flat member 102 and a tray T.

Figure 5A:
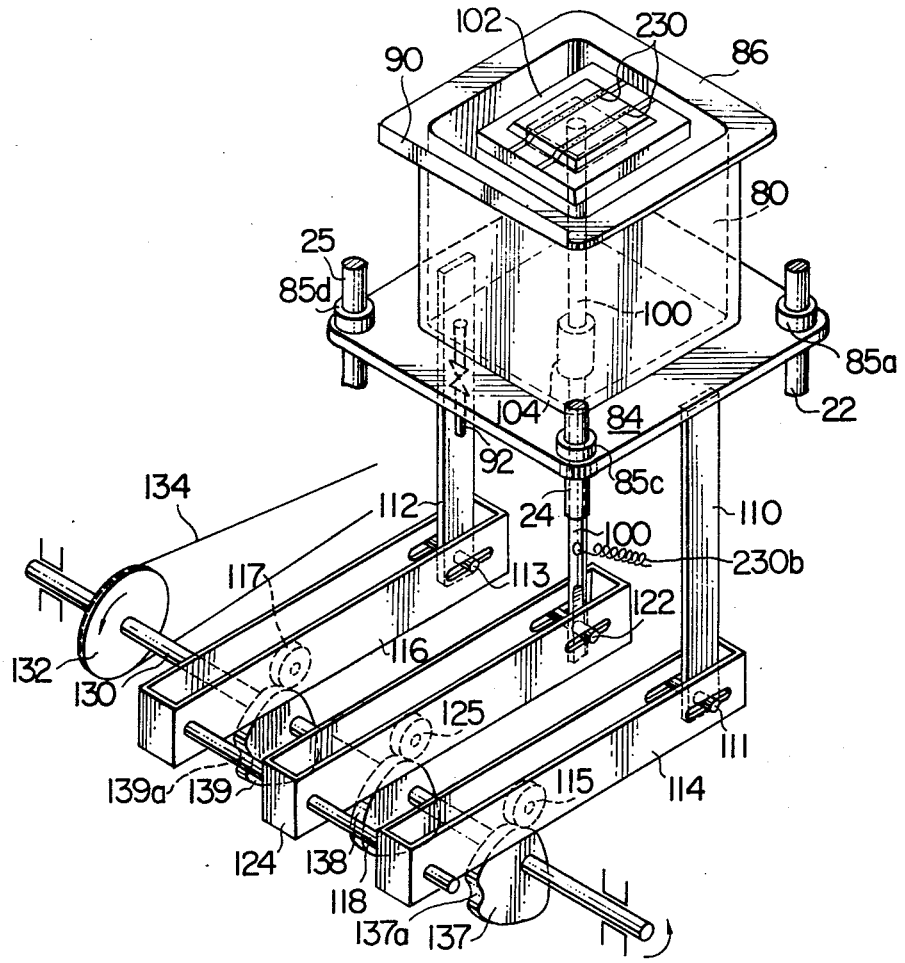
FIG. 5A is a fragmentary perspective view of a tubular member, a goods supporting flat member and a driving mechanism therefor shown in FIG. 2.
Figure 5B:
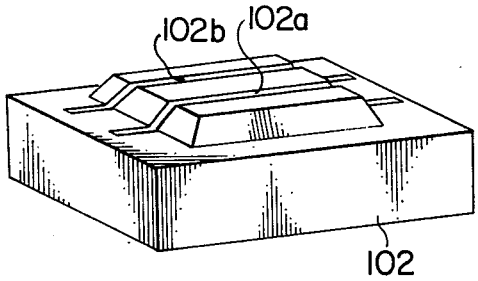
FIG. 5B is an enlarged perspective view of the good supporting flat member shown in FIG. 5A.
Figure 5C:
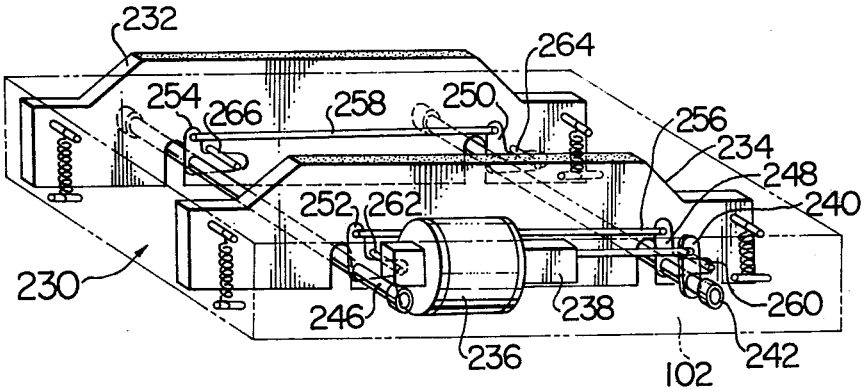
FIG. 5C is a further enlarged perspective view of heating means partly shown in FIG. 5B.
Figure 5D:
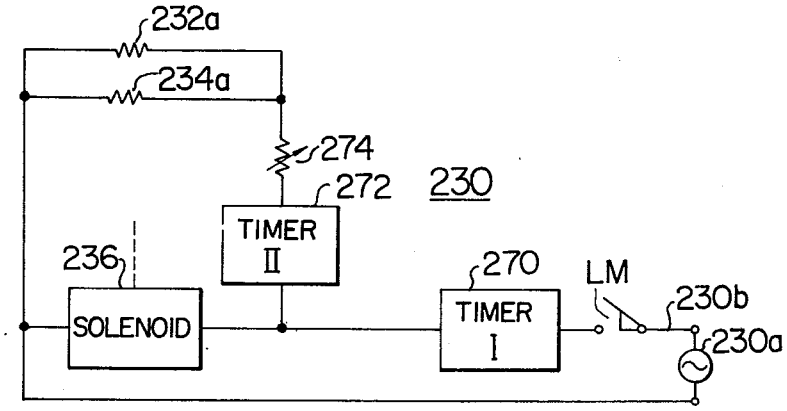
FIG. 5D is an electric circuit diagram used with the heating means shown in FIG. 5C.

Referring to FIGS. 5A to 5D, heat sealing means 230 are provided in the goods supporting flat member 102. The sealing means 230 are preferably in the form of an impulse heater the details of which are shown in FIGS. 5C and 5D. As will be seen in FIG. 5C, a pair of spaced, parallel, elongated heater supports 232 and 234 are disposed within the member 102 and extend longitudinally thereof. The heater supports have elevated, flat tops on which thin, elongated electric heater elements (not shown) are mounted and are covered with layers of heat-resistant, electrically insulating material, such as silicone rubber or Teflon (Trade Mark), which are exposed through slots 102*a* and 102*b* formed in the top of the member 102. The heater supports 232 and 234 are preferably made from a heat-resistant, electrically insulating material. Alternatively, the heater supports may be made of a metal. In the alternative case, additional electrically insulating layers may be disposed between the heater elements and the supports, respectively. A solenoid 236 is fixed to the member 102 and has its core 238 connected to a crank arm 240 rigidly secured to a shaft 242 which is rotatably mounted at its ends on the member 102 and extends under the heater supports 232 and 234 substantially at right angles thereto. A similar shaft 246 extends under the heater supports and rotatably mounted at its ends on the member 102. The shaft 242 has bell cranks 248 and 250 secured thereto, whereas the other shaft 246 has bell crank 252 and 254 secured thereto. The two pairs of the bell cranks 248 and 252 and 250 and 254 are connected at their one arms by means of tie rods 256 and 258, respectively. Pins 260, 262, 264 and 266 extend laterally from the respective heater supports 234 and 232 and are adapted to be engaged by the other arms of the bell cranks 248, 252, 250 and 254, respectively, to lift the heater supports 234 and 232 when the solenoid 236 is energized to rotate the shafts 242 and 246.

FIG. 5D illustrates an electric circuit diagram employed in the sealing means 230. The sealing means are adapted to be energized for a short time after the tucking plates 150 and 156 have been moved to their outermost positions. For this purpose, a limit switch LM included in the circuit is disposed adjacent the outer edge of one of the tucking plates 152, as shown in FIG. 6, so as to be actuated thereby when the tucking plate 152 is moved to its outermost position. The limit switch LM is normally opened. A variable resistor 274 is provided in the circuit in series with the timer-II 272 so as to adjust the voltage applied to the heater elements 232*a* and 234*a* depending upon the particular property of the film material employed. When the switch is closed, timer-I 270 and timer-II 272 are simultaneously made conductive so that the heater elements 232*a* and 234*a* and the solenoid 236 are simultaneously energized. After the heater elements are energized for a short period of time which may be about 0.1 to 0.5 seconds, the timer-II 272 is adapted to switch off the heater elements, whereas the other timer-I 270 is adapted to switch off after the lapse of 0.5 to 1.0 second from the deenergization of the heater elements, for the reason to be made apparent later. The sealing means 230 are electrically connected to a power source 230*a* by means of conductors 230*b* which extend through the rod 100 (FIG. 5A) and through an opening in the peripheral wall thereof.

In operation, a roll R of a continuous length of web of film material is mounted on the apparatus and a length of the web is drawn out of the roll R and threaded around the dancer roller 55 into the nips between the two pairs of endless belts 40 to 46. When the motor M is switched on, the cam member 62 is rotated to oscillate the rocker arm 68 so that the rack bar 70 is moved a stroke whereby the mating runs of the two pairs of the endless belts are moved a step in the direction indicated by the arrow A, FIG. 2, to advance the leading end portion of the web W into the wrapping station WS in which the leading edge of the web is positioned slightly forwardly beyond the forward side of the bead 87*b*.

Figure 8A:
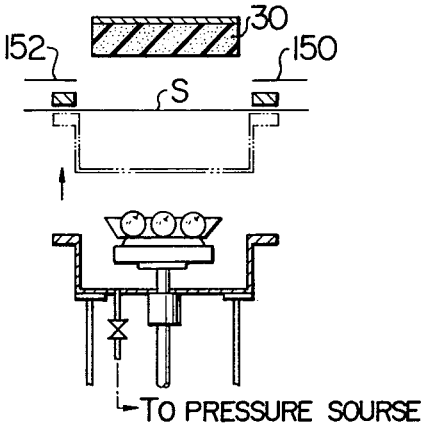
FIGS. 8A to 8D diagrammatically illustrate some of the operating steps of the apparatus of the invention shown in FIGS. 1 to 7F.

Goods to be wrapped, for example, a tray and foods therein as shown, will be placed on the flat member 102 while the tubular member 80 is located in its lowermost position shown in FIG. 2. This will mean that the goods may be placed on the flat member 102 either before the sheet is fed to the wrapping station or at the same time the sheet is supplied to the wrapping station. FIG. 8A diagrammatically illustrates the apparatus at this stage of operation. Also it will be seen in FIGS. 7A, 7C and 7E that the tray T is so positioned on the flat member 102 that the tray, if it is of a rectangular shape, has its longer sides extending substantially parallel with the lower pair of tucking members 154 and 156.

Figure 8B:
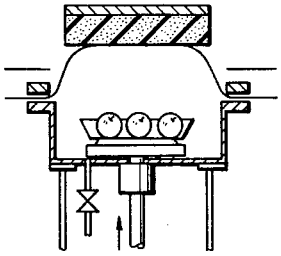

The rotation of the motor M is also transmitted through the shaft 63, the pulley 136 and the belt 134 to the pulley 132 so that the cam shaft 130 is also rotated in timed relationship with the cam shaft 63 and thus the endless belts 40 to 46. After the leading end portion of the web W is fed to the wrapping station WS, the cam members 137 and 139 operate to lift the tubular member 80 so that the knife 90 is first brought into cutting engagement with the web W to sever a rectangular sheet from the web. The tubular member 80 is further moved upwardly until the top surface of the upper flange 86 is urged against the under suface of the bead 87*b* with the peripheral edge portions of the sheet sandwiched or interposed therebetween. Thereafter, the valve 92 is opened to introduce a gaseous pressure from a pressure source, not shown, into the space defined by the tubular member 80 and the sheet of film material extending thereover to upwardly stretch the central portion of the sheet for thereby forming a bubble ballooning upwardly through the opening 87*a* until the top of the bubble is engaged by the under surface of the resiliently deformable pad 30, as shown in FIG. 8B.

Figure 8C:
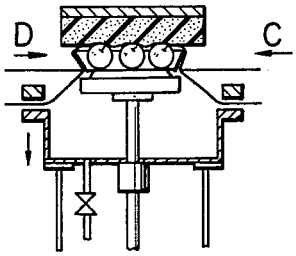

Then, the cam member 138 upwardly moves the flat member 102 together with the goods thereon to the uppermost position of the member 102 in which the top of the member 102 is positioned slightly above the lower pair of tucking members 154 and 156, as described above. The level of the pad 30 is adjusted such that, when the flat member 102 is lifted to its uppermost position discussed, the top of the goods on the member 102 is in pressure contact with the under surface of the pad 30 to upwardly depress and to be resiliently born by the under surface of the pad, as shown in FIG. 8C. At this time, the tucking members 150 and 156 are in the open positions shown in FIGS. 6, 7A and 7B.

Figure 8D:
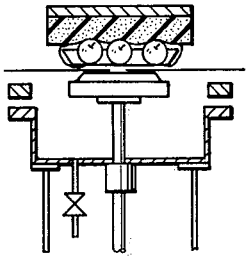

The nose portions of the cam members 220 and 224 are then rotated away from the associated cam followers 222 and 226 on the rocker arms 200 and 210, respectively, so that the tension springs 151*a*, 151*b*, 155*a* and 155*b* inwardly pull the tucking plates 150 to 156, as indicated by arrows C, D, E and F in FIG. 7C, so that the tucking plates are urged against the marginal portions of the sheet and inwardly tuck these portions. Around the time when the tucking plates 150 to 156 urge the marginal portions of the sheet S inwardly against the peripheral edge portion of the bottom of the tray T, as shown in FIGS. 7D and 8C, the friction between the tucking plates and the sheet S and between the sheet S and the tray T will become large enough to restrain the tucked portions of the sheet from being pulled upwardly by the resilient shrinkage in the portion of the sheet S above the peripheral edge portion of the tray. At this time, the arcuate recesses 137*a* and 139*a* in the peripheries of the cam members 137 and 139 are brought into engagement with the cam followers 115 and 117 on the rocker arms 114 and 116, respectively, so that the tubular member 80 is abruptly moved down off the bead 87*b* of the flat frame member 87 to release the edge portions of the stretched sheet S and exhaust the gaseous pressure from the tubular member. The tucking members are further moved inwardly to their innermost positions shown in FIGS. 7E, 7F and 8D in which the inner edge portions of the tucking members are wedged between the tray T and the flat member 102 so that the tray and goods thereon are slightly lifted against the resilient pad 30, and at the same time, the marginal portions of the sheet S are folded against the bottom surface of the tray. It will be seen in FIGS. 7E and 7F that, in the innnermost positions, the tucking plates 154 and 156 of the lower pair, i.e., the tucking plates along the longitudinal sides of the tray T, are overlapped a distance which is preferably from 2 to 20 millimeters, whereas the tucking plates 150 and 152 of the other pair are spaced a distance which is preferably from 2 to 10 centimeters. This arrangement is also applicable to square trays, not shown. The tucking plates 154 and 156 are overlapped in the innermost positions for the purpose of overlapping surplus edge portions of the sheet at the central portion of the bottom surface of the tray so that the tray is entirely wrapped with the sheet. The tucking plates 150 and 152 are spaced in their innermost positions for the following reasons: (1) It is sufficient for the tucking plates 150 and 152 to be stopped at the positions shown because the under surface of the tray is completely covered with the sheet by the overlapping movements of the other tucking plates; and (2) If the tucking members 150 and 152 are moved further inwardly, surplus edge portions are collected or gathered at the central portion of the bottom surface of the tray to spoil the appearance of a resultant package as well as to make it difficult to heat seal the tucked edges together.

The surplus edge portions of the sheet thus tucked against the bottom surface of the tray present such as symmetrical regular folded pattern as seams appearing in one surface of a closed adhesive envelope.

With the arrangement of the cam members 220 and 224 on the cam shaft 63 shown in solid lines in FIG. 6, the tucking plates 150 to 156 are simultaneously moved inwardly and outwardly. However, when the cam member 224 is angularly offset with respect to the cam member 220 as shown in broken lines 224' in FIG. 6, the tucking plates 154 and 156 are moved in different time phase with respect to the movements of the other pair of tucking members 150 and 152. In any case, both tucking plates of each pair must be moved simultaneously and at the same speed. The tucking plates of one pair may be moved either at the same speed as or at a different speed from the speed of the tucking plates of the other pair. The speeds of the inward movements of the tucking plates are determined on the consideration of the physical property of the wrapping material, i.e., the stretchable plastics film material to be used and the shape and form of the goods to be wrapped. It will be apparent to those in the art that the speeds of the tucking plates 150 to 156 depend upon the profiles of the cam members 220 and 224.

After the tucking plates have reached their innermost positions discussed, they are moved toward their outermost positions by the actions of the cam members 220 and 224. In general, the marginal portions thus tucked against the bottom face of the tray T will be retained in the tucked positions for a while by the force of adhesion inherent to the film material. If the adhesion is insufficient to keep tucked the marginal portions of the sheet and/or if the package thus produced in intended for storage for a long time, the tucked marginal portions of the sheet may be heat sealed together by the heat sealing means 230.

When the limit switch LM is closed by the tucking plate 152, the timer-I 270 and timer-II 272 become conductive so that the solenoid 236 and the heater elements **232*a* and 234*a* are simultaneously energized with the result that the heater supports 232 and 234 are lifted to bring the covering layers of the heater elements into engagement with the tucked edge portions of the sheet and that the covering layers are heated by the heater elements to a temperature sufficiently high to fuse the film material. The heater elements are energized for a short period of time and, after the lapse of that period of time, are deenergized by the timer-II 272. However, the covering layers of the heater elements are kept contact with the tucked edge portions of the sheet until the fused parts of the sheet are set to seal the tucked edge portions together. Thereafter, the timer-I 270 deenergizes the solenoid 236 so that the heater supports 232 and 234** are moved down to lower the covering layers of the heater elements down off the heat sealed parts of the sheet.

Then, the goods supporting flat member 102 is lowered to its lowermost position where a package of the goods is ready for unloading.

Figure 14:
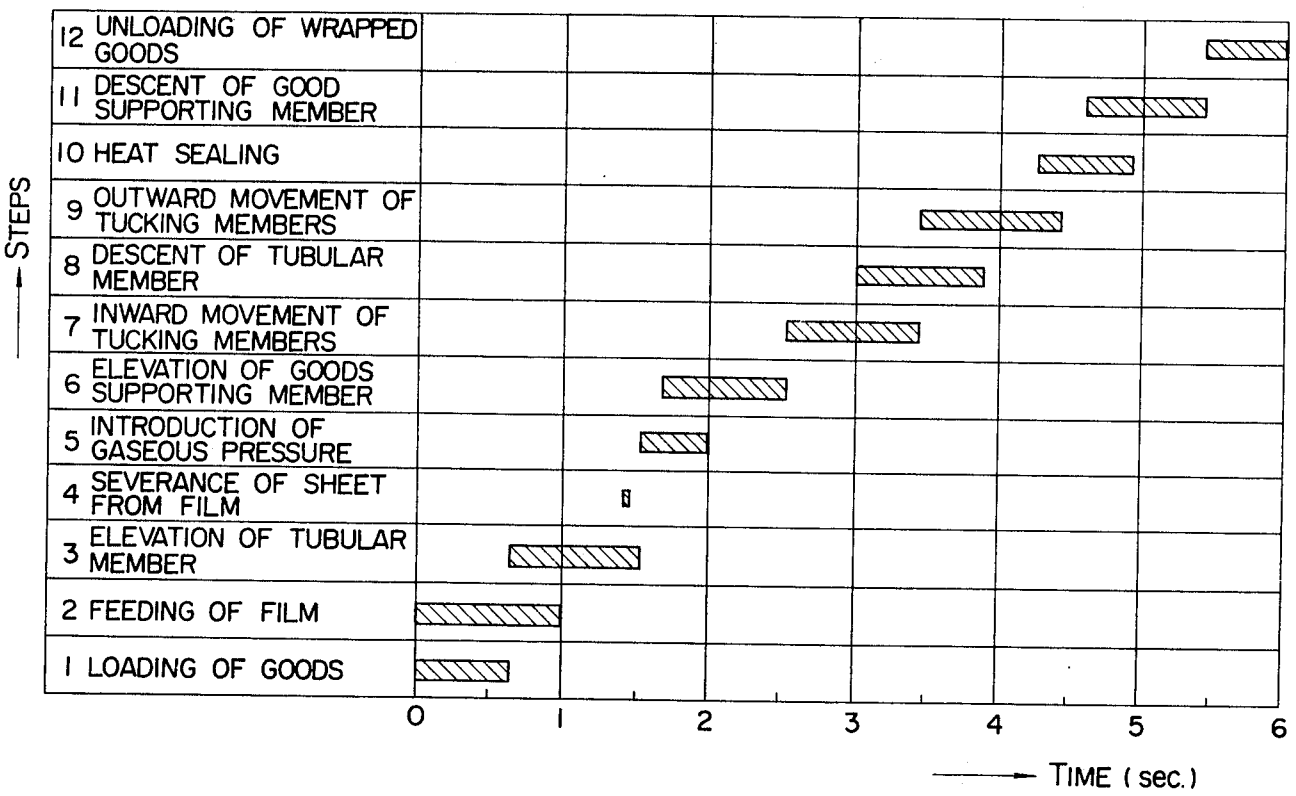
FIG. 14 diagrammatically illustrates the operating chart of the apparatus shown in FIGS. 1 to 8D.

The apparatus of the described embodiment of the invention operates in the manner shown in the operation chart illustrated in FIG. 14.

With the described method and appparatus according to the present invention, since the goods to be wrapped is introduced into a bubble formed by a stretched central portion of a sheet S of a resiliently deformable plastics film material, the central portion of the sheet S is not placed in any frictional engagement with the goods during the stretching step of the central portion of the sheet. Thus, the central portion of the sheet S can advantageously be stretched uniformly throughout the central portion of the sheet. In addition, the method and apparatus of the invention can employ stretchable film materials which could not be used with the prior art stretch wrapping because of their inherent physical properties that the film materials were apt to be damaged when subjected to frictional engagements with other objects during stretching steps.

With the prior art method shown in FIG. 1, a sheet S of a stretchable film was fed to a wrapping station above goods G to be wrapped, as shown in broken lines, and held fast adjacent the edges of the sheet by means of clamps C. Then, the goods G were upwardly moved against the under surface of the sheet S to upwardly stretch the central portion of the sheet for thereby forming a bubble or bag-like wrapper over the goods G until the top of the bubble was brought into engagement with the under surface of a resilient bearing means RB. It will be noted that, during the stretching step of the prior art, the tops of the goods and the sharp edges of a tray in which the goods were contained were brought into frictional engagement with the sheet being stretched, with a disadvantageous result that the sheet was unevenly stretched to form wrinkles. In an extreme or the worst case, the sheet was broken at the point of frictional engagement with the sharp edge of the tray or with a projection on the goods. With the prior art method, therefore, a stretchable sheet which would be suitable for the combination of the goods and a tray had to be determined on the consideration of the particular shapes of the goods and the material from which the tray was made so that the goods and the tray were smoothly slidable on the surface of the sheet. However, the film was also required to have an inherent adhesive characteristic in order that the marginal portions of the stretched sheet might be conveniently adhered to the bottom of the tray in the tucking step which was to follow the stretching step. The slidability and adhesion are opposite in nature and, accordingly, it was impossible to obtain a stretchable film material which would satisfy all the requirements.

Other embodiments of the present invention will be described with reference to FIGS. 9A to 13B throughout of which parts similar to those in the preceding embodiment will be designated by similar reference numerals.

Figure 9A:
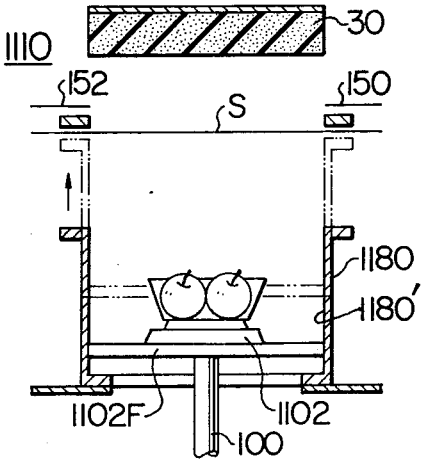
FIGS. 9A and 9B are digrammatic illustrations of another embodiment of the apparatus of the invention with parts of the apparatus being shown in different positions.
Figure 9B:
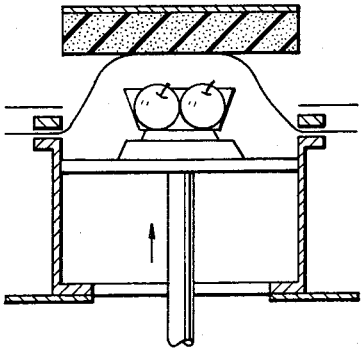

Referring to FIGS. 9A and 9B, a second embodiment of the invention generally indicated by 1110 is intended to produce a gaseous pressure by means of a tubular member 1180 and a good supporting member 1102 having an outwardly extending flange 1102F which is in slidable sealing engagement at its outer periphery with the peripheral inner surface 1180' of the tubular member 1180. The tubular member has open top and bottom and a larger axial dimension as compared with the tubular member 80 of the preceding embodiment. Other components and arrangement of the embodiment are substantially identical with those of the first embodiment. The tubular member 1180 is first elevated into sheet-gripping engagement with a frame member 87. Then the goods supporting member 1102 with goods thereon is moved upwardly within the tubular member 1180. It will be noted that the air in the tubular member is compressed by the upward movement of the goods supporting member so that the central portion of the sheet S is upwardly stretched to form a bubble as shown in FIG. 9B. The rest of the operation of the embodiment is identical with that of the first embodiment.

Figure 10:
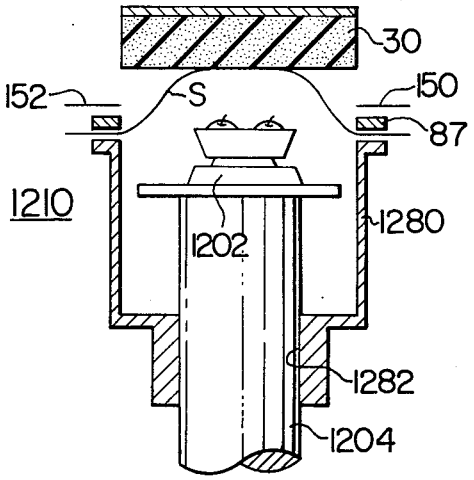
FIG. 10 is a diagrammatic illustration of a further embodiment of the apparatus of the invention.

A third embodiment of the invention is shown in FIG. 10 and generally indicated by 1210. This embodiment is similar to the embodiment shown in FIGS. 9A and 9B and is also intended to produce a gaseous pressure by itself. For this purpose, the embodiment includes an open-topped, substantially tubular member 1280 provided with an axial bore 1282 formed in the bottom of the member 1280. A goods supporting member 1202 is provided within the tubular member 1280 and has a stem or plunger 1204 extending downwardly from the goods supporting member 1202. The plunger 1204 is in slidable sealing engagement with the inner peripheral surface of the bore 1280 so that, when the plunger is upwardly moved relative to the tubular member 1280 which is in sealing engagement with a sheet S, air is compressed within the space defined by the sheet, the tubular member and the plunger to form a bubble in the central portion of the sheet in the manner just similar to that in the embodiment shown in FIGS. 9A and 9B. The rest of the arrangement and operation is substantially identical with that of the first embodiment of the invention.

Figure 11A:
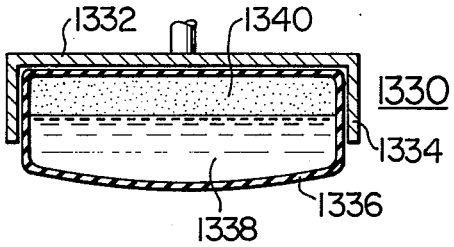
FIGS. 11A and 11B diagrammatically illustrate in section a modification of a resiliently deformable pad shown in FIGS. 2 and 8A to 10.
Figure 11B:
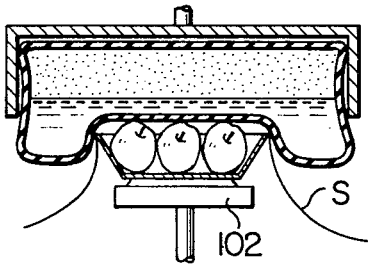

FIGS. 11A and 11B illustrate a modified form of the resiliently deformable means 30 of the first embodiment. The modification is generally indicated by 1330 and includes on open-bottomed enclosure 1332 having a downwardly extending skirt 1334. The enclosure 1332 houses a bag 1336 of a flexible, fluid impermeable sheet material, such as natural rubber, polybutadiene-styrene rubber, polyisobutylene isoprene rubber, polybutadieneacrylonitrile rubber, polyacrylic rubber, polysulfide synthetic rubber, urethane rubber, silicone rubber, fluorine rubber, rubber-coated woven fabric or soft synthetic resin such as vinyliden chloride or a laminated sheet material of a combination of some of the above materials. The bag contains a liquid 1338 such as water and a gaseous medium 1340 such as air. The amount of the liquid 1338 relative to the amount of the gaseous medium 1340 in the bag is determined dependent on the nature of goods to be wrapped and the shape thereof.

When the goods are urged against the bottom surface of the bag 1336, the bottom surface will be easily inwardly deformed into softly surrounding relationship with the goods, as will be seen in FIG. 11B because the marginal portion of the bag is backed up by the skirt 1334. Thus, the bag 1336 is operable to pack even a frigile food such as grape in a sheet of a stretchable film material. In addition, as the inwardly deformed portion of the bag is in intimate frictional engagement with the upper part of the bubbled sheet S, the marginal portions of the sheets are not liable to be upwardly pulled by the resiliency of the stretched upper part of the bubble during the tucking operation of the marginal portions of the sheet. Thus, the stretched upper part of the sheet is unloosened after the tucking operation with a resultant good appearance of the package.

Figure 12A:
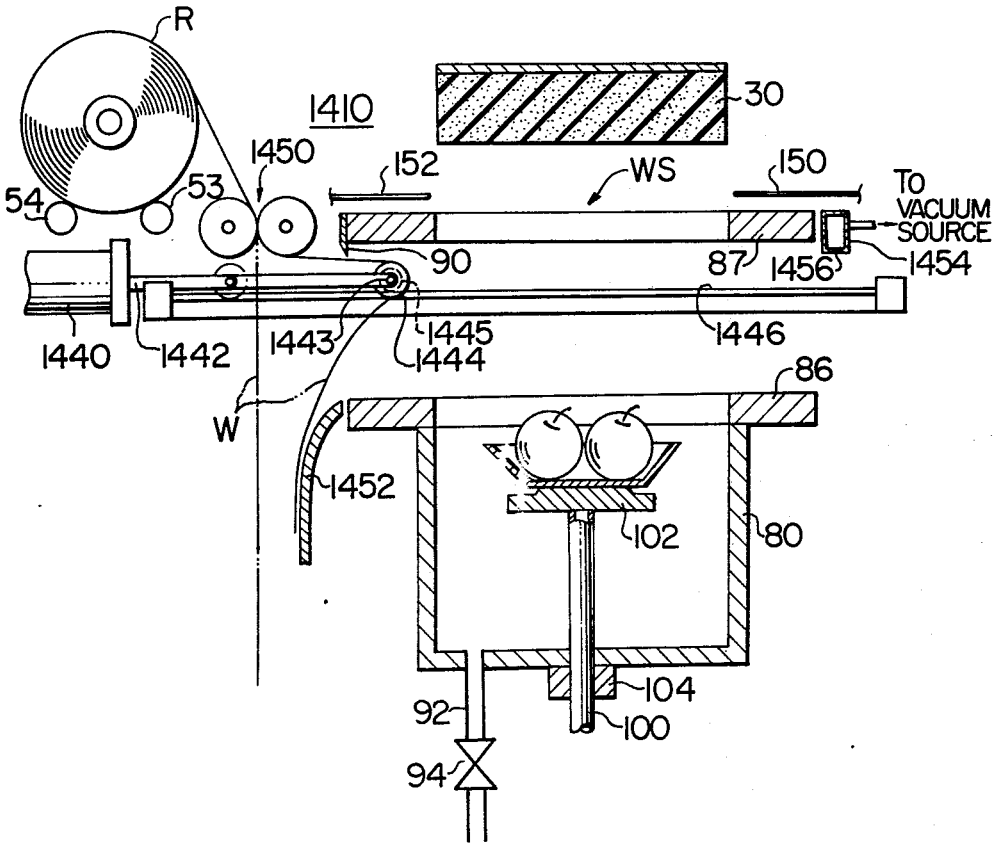
FIGS. 12A to 12C are partially sectional, fragmentary, diagrammatic side views of a further embodiment of the apparatus of the invention with parts of the apparatus being shown in different positions.
Figure 12B:
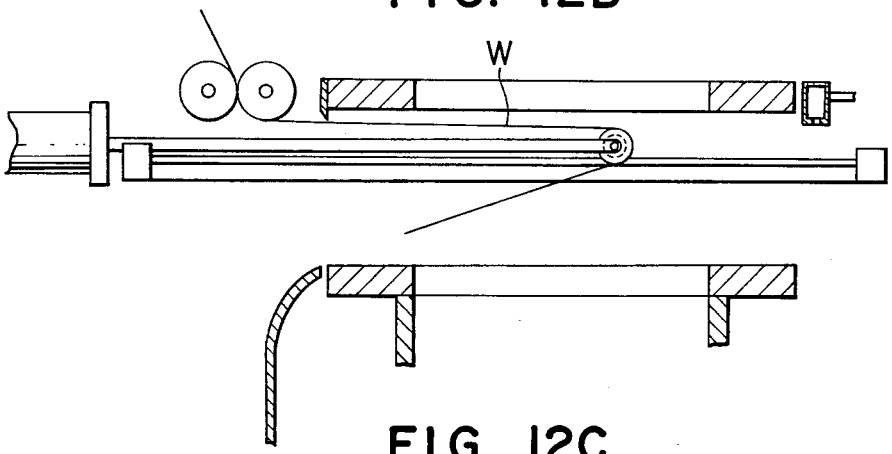
Figure 12C:
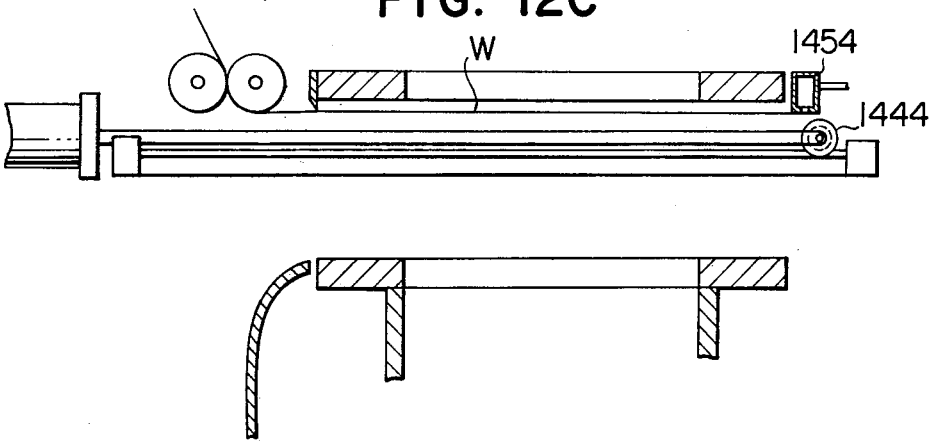

FIGS. 12A to 12C illustrate a further or fifth embodiment of the invention which is directed to a modification of the sheet feeding means. So as to feed a sheet of a stretchable plastic film material to the wrapping station, the embodiment employs a fluid pressure actuated piston-cylinder assembly 1440 in place of a unit of intermittently driven endless belts as used in the first embodiment. The piston-cylinder assembly 1440 is horizontally disposed beneath rollers 53 and 54 which support a roll R of continuous web of a stretchable film material. A piston rod 1442 of the assembly 1440 is rigidly connected with an axle 1443 extending transversely of the piston rod. The axle 1443 rotatably carries thereon an elongated roller 1444 and a pair of wheels 1445 (one of which is shown) disposed adjacent the opposite ends of the roller. The roller 1444 has an axial dimension substantially equal to or larger than the width of the web of the film material. The wheels 1445 are in rolling engagement with a pair of parallel, spaced rails (one of which is shown at 1446) which are spaced a distance slightly larger than the width of the web of the film and extend horizontally bellow a flat frame member 87. A film drawer 1450 in the form of a pair of drawing rollers is provided between the roller 53 and the frame member 87 and above the rails 1446 and is so controlled as to draw a predetermined length of web in each cycle of operation of the apparatus. The drawn length of web is adapted to hung from the nip of the drawing rollers 1450, as indicated by W in FIG. 12A. An apron 1452 is provided between the web W hung from the drawing rollers and a tubular member 80 when located in its lower position. A knife 90 is provided along one edge of the frame member 87 adjacent the drawer rollers 1450 rather than along an edge of an upper flange 86 of the tubular member 80 as in the first embodiment. An elongated tubular member 1454 extends parallel with another edge of the frame member 87 opposite to the edge thereof having the knife 90 thereon and is connected to a vacuum source, not shown. A row of a plurality of apertures or perforations 1456 formed in the bottom face of the tubular member 1454 along the length thereof. The rest of the components and the arrangement of the embodiment is substantially identical with those of the first embodiment.

In operation, goods are loaded on a goods supporting flat member 102. A length of web W is drawn from the roll R by the drawer rollers 1450 and is hung therefrom. Then, the cylinder-piston assembly is actuated to protrude the piston rod 1442. As the cylinder-piston assembly is actuated to protrude the piston rod 1442, the wheels 1445 are moved along the rails 1446 from the left to the right as viewed in FIG. 12A. The roller 1444 is brought into rolling engagement with the hung web W so that is is pulled rightwards as viewed in FIG. 12A while it is slid on the surface of the apron 1452, as will be seen in FIG. 12B. When the roller 1444 reaches the dead center of its forward stroke located substantially beneath the perforated tubular member 1454, the leading end of the drawn length of the web W is positioned beneath the row of the apertures 1456 in the tubular member 1454 and is sucked against the bottom face thereof by the vacuum applied to the tubular member. Then, the piston rod 1442 is retracted to return the roller 1444 to its initial position while the leading end of the web W remains stuck to the perforated tubular member 1454. Thereafter, the tubular member 80 is elevated until the upper flange 86 is moved past the rails 1446 to grip the web W with the frame member 87. Substantially at the same time, the knife 90 severs a sheet from the length of web W. The rest of the operation is substantially identical with that in the first embodiment of the invention.

Figure 13A:
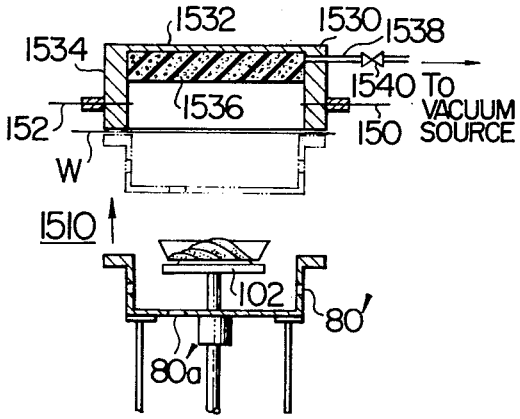
FIGS. 13A and 13B are fragmentary, diagrammatic side views of a still further embodiment of the apparatus of the invention with parts of the apparatus being shown in different positions.
Figure 13B:
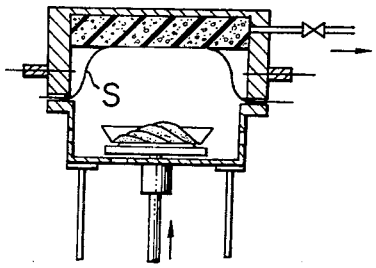

A further embodiment shown in FIGS. 13A and 13B is drawn to a modification to the differential pressure producing means. The modification comprises an open-bottomed enclosure 1530 having a substantially horizontal top 1532 and a downwardly depending circumferential skirt 1534 which defines with the top 1532 an open-bottomed chamber in which a pad 1536 of a resiliently deformable, gas permeable cellular material having open cells therein, such as a foamed plastics material is disposed and extends across the inner surface of the top 1532 and is attached thereto. A conduit 1538 having a valve 1540 therein extends inwardly through the skirt 1534 to the pad 1536 and has its outer end connected to a vacuum source, not shown. Tucking plates (only two of which 150 and 152 are shown) extend through slits (not shown) in the skirt 1534 in air tight manner for inward and outward movements, respectively. A tubular member 80' is disposed beneath the enclosure 1530 and reciprocable up and down. An air inlet **80'*a* is formed in the bottom wall of the tubular member 80'. It will be apparent to those in the art that the modification being described is applicable to either the embodiment shown in FIGS. 12A to 12C**.

In operation, a length of web of a stretchable film material W is fed to a wrapping station beneath the enclosure 1530. Then, the tubular member 80' is lifted to clamp the web W and sever a sheet S from the web by means of a knife which is not shown but may be similar to the knife 90 in the preceding embodiments. The valve 1540 is opened to communicate the vacuum source, not shown, with the interior of the enclosure 1530 so that air in the space defined by the enclosure and the sheet S is discharged from the space through the open cells in the gas permeable pad 1536 and through the conduit 1538 to upwardly stretch the central portion of the sheet S for thereby forming a bubble until the top of the bubble is engaged by the under surface of the pad as shown in FIG. 13B. Then, a flat member 102 with goods thereon is elevated to introduce the goods into the bubble. The rest of the operation is substantially identical with that in the first embodiment.

While the invention has been herein shown and described in what are presently conceived to be the most practical and preferred embodiments, it will be apparent that many modifications may be made thereof within the scope of the invention, which scope is to be accorded the broadest interpretation of the appended claims so as to encompass all equivalent apparatus and methods.

We claim:

1. A method of wrapping an assembly of articles on a tray in an elastic and stretchable plastics film material, comprising the steps of feeding a sheet of the plastics film material to a predetermined position above the assembly of articles on a tray to be wrapped and beneath a resiliently deformable bearing means, subjecting said sheet to a differential pressure to form an upwardly stretched bubble in the central zone of said sheet while portions of said sheet adjacent at least two opposite edges thereof are held fast until the top of the bubble is engaged by said bearing means, causing relative movement of the assembly of articles on a tray with respect to the bubbled sheet to introduce the assembly of articles on a tray into the bubble and to upwardly depress said bearing means, and positively maintaining the engagement between the top of the bubble and the upwardly depressed portion of the bearing means while tucking the edges of said sheet against the side of the assembly of articles on a tray remote from the bubble to secure said edges together.

2. A method according to claim 1, wherein a gaseous pressure is exerted to the under surface of said sheet to cause said differential pressure.

3. A method according to claim 2, wherein suction is additionally applied to the upper surface of said sheet.

4. A method according to claim 1, wherein are lifted into said bubble while said bubbled sheet is held stationary.

5. A method the assembly of articles on a tray according to claim 1, wherein said sheet has a quadrilateral shape and wherein the opposite edges of one of the two pairs are tucked simultaneously and then the remaining edges are tucked simultaneously.

6. A method according to claim 1, wherein said sheet has a quadrilateral shape and wherein the four edges of said sheet are simultaneously tucked.

7. A method according to claim 1, wherein suction is applied to the upper surface of said sheet to cause said differential pressure.

8. A method according to claim 1, further including the step of sealing said secured edges.

9. A method according to claim 2, wherein said gaseous pressure is produced by a gaseous medium selected from a group consisting of air, $N_2$, $O_2$ and $CO_2$.

10. A method of wrapping goods in an elastic and stretchable plastics film material, comprising the steps of feeding a quadrilateral sheet of the plastics film material to a predetermined position above goods to be wrapped and beneath a resiliently deformable bearing means, subjecting said sheet to a differential pressure to form an upwardly stretched bubble in the central zone of said sheet while portions of said sheet adjacent at least two opposite edges of said sheet are held fast until the top of the bubble is engaged by said bearing means, lifting said goods into the bubble and to an elevated position in which the top of said goods is urged against the inner surface of the top of the bubble to upwardly depress said bearing means, tucking one of the two pairs of the opposite edges of said sheet substantially simultaneously against the side of said goods remote from said bearing means by a pair of tucking members having substantially straight sheet-engaging edges which are substantially parallel with each other, then tucking the other pair of opposite edges of said sheet substantially simultaneously over and against the tucked edges by another pair of tucking members having substantially straight sheet-engaging edges which are substantially parallel with each other and substantially perpendicular to the sheet-engaging edges of the first-mentioned pair of tucking members to thereby secure all the edges together, and positively keeping said goods at said elevated position to maintain the engagement between the top of the bubble and said upwardly depressed portion of said bearing means during the tucking steps.

11. A method of wrapping goods according to claim 10, wherein a gaseous pressure is exerted to the under surface of said sheet to cause said differential pressure.

12. A method of wrapping goods according to claim 10, wherein suction is applied to the upper surface of said sheet to cause said differential pressure.

13. A method of wrapping goods according to claim 10, further including the step of sealing said secured edges.

14. An apparatus for wrapping goods in an elastic and stretchable plastics film material, comprising a wrapping station, a resiliently deformable bearing means at said wrapping station, means beneath said bearing means for supporting goods to be wrapped, means for feeding a sheet of the plastics film material to a position beneath said bearing means and above goods supported on said goods supporting means, means for driving said feeding means, a tubular means reciprocable between a lower position downwardly spaced from said sheet and an upper position in which said tubular means has its tubular top engaged with the under surface of said sheet, means for reciprocating said tubular means between said lower and upper positions, stationary means below said bearing means and above said sheet cooperative with said tubular top of said tubular means to hold said sheet adjacent the periphery thereof when said tubular means is in its upper position, said tubular means having a substantially closed bottom wall defining with the periphery wall of said tubular means an open-topped chamber, means for introducing gaseous pressure into said open-topped chamber to exert a gaeous pressure to the under surface of the central portion of said sheet when said tubular means is in said upper position whereby said central portion is stretched upwardly to form a bubble until the top of the bubble is engaged by said bearing means, for lifting said goods supporting means and goods thereon to introduce the goods into said bubble until the top of said goods is urged against the portion of the bubbled sheet engaged by said bearing means, two pairs of tucking members disposed at said wrapping station above said stationary means, the tucking members of each pair being horizontally spaced and movable toward and away from each other to fold the opposite edge portions of said sheet after the top of said goods are urged against the bubbled sheet so that the edge portions are secured together.

15. An apparatus for wrapping goods according to claim 14, wherein said bearing means comprises a resiliently deformable pad.

16. An apparatus for wrapping goods according to claim 14, wherein said bearing means comprises a deformable bag containing an amount of fluid.

17. An apparatus for wrapping goods according to claim 16, further including an open-bottomed enclosure, said bag having at least an upper portion thereof received in said enclosure, the peripheral wall of said enclosure being adapted to laterally inwardly support the peripheral outer portion of said bag at least when the bubbled sheet and goods are urged against the bottom surface of said bag.

18. An apparatus for wrapping goods according to claim 14, wherein said feeding means includes a roll of continuous web of said plastics film material, means for rotatably supporting said roll on said apparatus, two parallel pairs of upper and lower endless belts each pair having substantially horizontal mating runs extending through said wrapping station in close contacting relationship with each other, said pairs of upper and lower endless belts being spaced widthwise a distance substantially equal to the width of said continuous web, the longitudinal edges of said web in the free end portion being sandwiched between said mating runs of said respective pairs of said endless belts, said pairs of upper and lower endless belts being adapted to be intermittently driven so that said mating runs are moved together with said free end portion of said web until said free end portion is conveyed to said wrapping station, and wherein the apparatus further includes means for severing a sheet from said continuous web.

19. An apparatus for wrapping goods according to claim 18, wherein said means for driving said feeding means includes means for producing intermittent reciprocal linear motions, means for converting said intermittent linear motions into intermittent rotational motions, and means for transmitting said intermittent rotational motions to one of shafts around which said endless belts extend.

20. An apparatus for wrapping goods according to claim 14, wherein said feeding means includes a roll of a continuous web of said plastics film material, means for rotatably supporting said roll on said apparatus, means for drawing a length of said web from said roll, means reciprocally movable along a substantially horizontal path through said wrapping station to feed said length of web to a position beneath said stationary means, and means for reciprocally actuating said reciprocally movable means, and wherein said apparatus further includes means for retaining the leading edge of the thus fed length of web and means for severing a sheet from said drawn length of web.

21. An apparatus for wrapping goods according to claim 14, further including means for sealing said secured edges of said sheet together.

22. An apparatus for wrapping goods according to claim 21, wherein said sealing means comprises a heat-sealing means provided in said goods supporting means.

23. An apparatus for wrapping goods according to claim 14, wherein said goods supporting means includes a shaft extending slidably through said bottom wall of said tubular means.

24. An apparatus for wrapping goods according to claim 14, further including means for causing movements of said tucking members so that said tucking members of the two pairs are simultaneously moved toward each other.

25. An apparatus for wrapping goods according to claim 24, wherein the tucking members of one of the two pairs are inwardly moved to a position in which the tucking members are overlapped.

26. An apparatus for wrapping goods in an elastic and stretchable plastics film material, comprising a wrapping station; means beneath said bearing means at said wrapping station; means beneath said bearing means for supporting goods to be wrapped; means for feeding a sheet of the plastics film material to a position beneath said bearing means and above goods supported on said goods supporting means; a tubular means reciprocable between a lower position downwardly spaced from said sheet and an upper position in which said tubular means has its tubular top engaged with the under surface of said sheet; means for reciprocating said tubular means between said lower and upper positions; stationary means below said bearing means and above said sheet cooperative with said tubular top of said tubular means to hold said sheet adjacent the periphery thereof when said tubular means is in its upper position; said feeding means including a roll of a continuous web of said plastics film material; means for rotatably supporting said roll on said apparatus; means for drawing a length of said web from said roll; means reciprocally movable along a substantially horizontal path through said wrapping station to feed said length of web to a position beneath said stationary means; means for reciprocally actuating said reciprocally movable means; means for retaining the leading edge of the thus fed length of web; said retaining means comprising an elongated tubular member disposed in substantially the same plane as said stationary means and extending generally parallel to the leading edge of the thus fed length of web, said tubular member being connected to a suction source and having a perforated bottom surface whereby the leading edge of said web is sucked against said bottom surface; means for severing said sheet from said drawn length of web; means for exerting a gaseous pressure to the under surface to the central portion of said sheet when said tubular means is in said upper position whereby said central portion is stretched upwardly to form a bubble until the top of the bubble is engaged by said bearing means; means for lifting said goods supporting means and goods thereon to introduce the goods into said bubble until the top of said goods is urged against the portion of the bubbled sheet engaged by said bearing means; and two pairs of tucking members disposed at said wrapping station above said stationary means, the tucking members of each pair being horizontally spaced and movable toward and away from each other to fold the opposite edge portions of said sheet after the top of said goods are urged against the bubbled sheet so that the edge portions are secured together.

27. An apparatus for wrapping goods according to claim 20, wherein said reciprocally actuating means comprises a fluid pressure operated piston-cylinder assembly.

28. An apparatus for wrapping goods in an elastic and stretchable plastics film material; comprising a wrapping station; a resiliently deformable bearing means at said wrapping station; means beneath said bearing means for supporting goods to be wrapped; means for feeding a sheet of the plastics film material to a position beneath said bearing means and above goods supported on said goods supporting means; means for driving said feeding means; a tubular means reciprocable between a lower position downwardly spaced from said sheet and an upper position in which said tubular means has its tubular top engaged with the under surface of said sheet; means for reciprocating said tubular means between said lower and upper positions; stationary means below said bearing means and above said sheet cooperative with said tubular top of said tubular means to hold said sheet adjacent the periphery thereof when said tubular means is in its upper position; said goods supporting means including a substantially vertically extending shaft and a substantially flat member extending substantially transversely of the axis of said shaft, said flat member being substantially coextensive with the cross-sectional area within said tubular means and having a peripheral edge portion in slidable sealing engagement with the inner periphery of said tubular means, the goods being supported on said flat member; means operatively connected to the bottom end of said shaft for lifting said flat member and goods thereon relative to said tubular means when the same is in its upper position; the upward movement of said flat member relative to said tubular means being operative to press air within said tubular means against the under surface of said sheet whereby the central portion of said sheet is stretched upwardly to form a bubble until the top of the bubble is engaged by said bearing means, the goods on said flat member being introduced into said bubble until the top of the goods is urged against the portion of the bubbled sheet engaged by said bearing means; and two pairs of tucking members disposed at said wrapping station above said stationary means, the tucking members of each pair being horizontally spaced and movable toward and away from each other to fold the opposite edge portion of said sheet after the top of said goods are urged against the bubbled sheet so that the edge portions are secured together.

29. An apparatus for wrapping goods in an elastic and stretchable plastics film material; comprising a wrapping station; a resiliently deformable bearing means at said wrapping station; means beneath said bearing means for supporting goods to be wrapped; means for feeding a sheet of the plastics film material to a position beneath said bearing means and above goods supported on said goods supporting means; means for driving said feeding means; a tubular means reciprocable between a lower position downwardly spaced from said sheet and an upper position in which said tubular means has its tubular top engaged with the under surface of said sheet; means for reciprocating said tubular means between said lower and upper positions; stationary means below said bearing means and above said sheet cooperative with said tubular top of said tubular means to hold said sheet adjacent the periphery thereof when said tubular means is in its upper position; said goods supporting means including a substantially vertically extending stem and a substantially flat member extending substantially transversely of the axis of said stem, said tubular means having a bottom wall defining therein a bore, said stem being in slidable sealing engagement with the inner peripheral surface of said bore, the goods being supported on said flat member; means operatively connected to the bottom end of said stem for lifting said flat member and goods thereon relative to said tubular means when the same is in its upper position; the upward movement of said flat member relative to said tubular means being operative to press air within said tubular means against the under surface of said sheet whereby the central portion of said sheet is stretched upwardly to form a bubble until the top of the bubble is engaged by said bearing means, the goods on said flat member introduced into said bubble until the top of the goods is urged against the portion of the bubbled sheet engaged by said bearing means; and two pairs of tucking members disposed at said wrapping station above said stationary means, the tucking members of each pair being horizontally spaced and movable toward and away from each other to fold the opposite edge portions of said sheet after the top of said goods are urged against the bubbled sheet so that the edge portions are secured together.

30. An apparatus for wrapping goods in an elastic and stretchable plastics film material, comprising a wrapping station, a resiliently deformable bearing means at said wrapping station, means beneath said being means for supporting goods to be wrapped, means for feeding a sheet of the plastics film material to a position beneath said bearing means and above goods supported on said goods supporting means, means for driving said feeding means, tubular means reciprocable between a lower position downwardly spaced from said sheet and an upper position in which said tubular means has its tubular top engaged with the under surface of said sheet, means for reciprocating said tubular means between said lower and upper positions, stationary means below said bearing means and above said sheet cooperative with said tubular top of said tubular means to hold said sheet adjacent the periphery thereof when said tubular means is in its upper position, means for exerting a gaseous pressure to the upper surface of the central portion of said sheet when said tubular means is in said upper position whereby said central portion is stretched upwardly to form a bubble until the top of the bubble is engaged by said bearing means, for lifting said goods supporting means and goods thereon to introduce the goods into said bubble until the top of said goods is urged against the portion of the bubbled sheet engaged by said bearing means, two pairs of tucking members disposed at said wrapping station above said stationary means, the tucking members of each pair being horizontally spaced and movable toward and away from each other to fold the opposite edge portions of said sheet after the top of said goods are urged against the bubbled sheet so that the edge portions are secured together, and means for causing movement of said tucking members so that the tucking members of one of the two pairs are simultaneously moved toward each other and then the tucking members of the other pair are simultaneously moved toward each other.

31. An apparatus for wrapping goods according to claim 30, wherein the tucking members of one of the two pairs are inwardly moved to a position in which the tucking members are overlapped.

32. An apparatus for wrapping goods in an elastic and stretchable plastics film material, comprising a wrapping station, an open-bottomed enclosure at said wrapping station defining therein an open-bottomed chamber, resiliently deformable bearing means extending substantially horizontally across said chamber, means beneath said bearing means for supporting goods to be wrapped, means for feeding a sheet of the plastics film material to a position beneath said bearing means and above goods supported on said goods supporting means, means for driving said feeding means, means reciprocable between a lower position downwardly spaced from said sheet and an upper position in contact with the undersurface of said sheet, means for reciprocating said reciprocable means between said upper and lower positions, said reciprocable means when in said upper position being cooperative with the bottom end of said enclosure to hold said sheet adjacent the periphery thereof, means for exhausting air from said chamber through said enclosure when said reciprocable means is in said upper position to exert vacuum to the upper surface of the central portion of said sheet whereby the same is stretched upwardly to form a bubble until the top of the bubble is engaged by said bearing means, means for lifting said goods supporting means and goods thereon to introduce the goods into said bubble until the top of said goods is urged against the portion of the bubbled sheet engaged by said bearing means, two pairs of tucking members disposed within said enclosure above the bottom end thereof, the tucking members of each pair being horizontally spaced and movable toward and away from each other to fold the opposite edge portions of said sheet after the top of said goods are urged against the bubbled sheet so that the edge portions are secured together.

33. An apparatus for wrapping goods according to claim 32, wherein said bearing means is gas-permeable to permit air flow therethrough and said exhaust means is operable to exhaust air from said chamber through said bearing means and through said enclosure.

34. An apparatus for wrapping goods according to claim 32, wherein said resiliently deformable bearing means comprises a pad of a resiliently deformable cellular material having open cells therein.

35. An apparatus for wrapping goods according to claim 32, wherein said feeding means includes a roll of continuous web of said plastics film material, means for rotatably supporting said roll on said apparatus, two parallel pairs of upper and lower endless belts each pair having substantially horizontal mating runs extending through said wrapping station in close contacting relationship with each other, said pairs of upper and lower endless belts being spaced widthwise a distance substantially equal to the width of said continuous web, the longitudinal edges of said web in the free end portion being sandwiched between said mating runs of said respective pairs of said endless belts, said pairs of upper and lower endless belts being adapted to be intermittently driven so that said mating runs are moved together with said free end portion of said web until said free end portion is conveyed to said wrapping station, and wherein the apparatus further includes means for severing a sheet from said continuous web.

36. An apparatus for wrappinbg goods according to claim 35, wherein said means for driving said feeding means includes means for producing intermittent reciprocal linear motions, means for converting said intermittent linear motions into intermittent rotational motions, and means for transmitting said intermittent rotational motions to one of shafts around which said endless belts extend.

37. An apparatus for wrapping goods according to claim 32, wherein said feeding means includes a roll of a continuous web of said plastics film material, means for rotatably supporting said roll on said apparatus, means for drawing a length of said web from said roll, means reciprocally movable along a substantially horizontal path through said wrapping station to feed said length of web to a position beneath said enclosure, and means for reciprocally actuating said reciprocally movable means, and wherein said apparatus further includes means for retaining the leading edge of the thus fed length of web and means for severing a sheet from said drawn length of web.

38. An apparatus for wrapping goods according to claim 37, wherein said reciprocally actuating means comprises a fluid pressure operated piston-cylinder assembly.

39. An apparatus for wrapping goods according to claim 37, wherein said retaining means comprises an elongated tubular member disposed in substantially the same plane as the bottom end of said open-bottomed enclosure and extending generally parallel to the leading edge of the thus fed length of web, said tubular member being connected to a suction source and having a perforated bottom surface whereby the leading edge of said web is sucked against said bottom surface.

40. An apparatus for wrapping goods according to claim 32, further including means for causing movements of said tucking members so that the tucking members of the two pairs are simultaneously moved toward each other.

41. An apparatus for wrapping goods according to claim 40, wherein the tucking members of one of the two pairs are inwardly moved to a position in which the tucking members are overlapped.

42. An apparatus for wrapping goods according to claim 32, further including means for causing movements of said tucking members so that the tucking members of one of the two pairs are simultaneously moved toward each other and then the tucking members of the other pair are simultaneously moved toward each other.

43. An apparatus for wrapping goods according to claim 42, wherein the tucking members of one of the two pairs are inwardly moved to a position in which the tucking members are overlapped.

44. An apparatus for wrapping goods according to claim 14, wherein said goods supporting means comprises a substantially flat member having its edges bevelled to guide said tucking members when they are moved to their innermost positions.

45. An apparatus for wrapping goods according to claim 32, wherein said goods supporting means comprises a substantially flat member having its edges bevelled to guide said tucking members when they are moved to their innermost positions.

* * * * *